United States Patent [19]

Masuda et al.

[11] Patent Number: 4,780,373

[45] Date of Patent: Oct. 25, 1988

[54] HEAT-TRANSFER MATERIAL

[75] Inventors: Yasuo Masuda, Urawa; Tsutomu Takahashi, Ohmiya; Yoshio Takizawa, Hasuda; Naokazu Yoshiki, Kitamoto, all of Japan

[73] Assignee: Mitsubishi Kinzoku Kabushiki Kaisha, Tokyo, Japan

[21] Appl. No.: 934,652

[22] Filed: Nov. 25, 1986

[30] Foreign Application Priority Data

Nov. 27, 1985 [JP] Japan ..... 60-266812
Mar. 5, 1986 [JP] Japan ..... 61-47763
Mar. 6, 1986 [JP] Japan ..... 61-48794

[51] Int. Cl.[4] ..... F28F 13/18

[52] U.S. Cl. ..... 428/586; 428/674; 428/687; 165/133

[58] Field of Search ..... 428/687, 613, 586; 165/133

[56] References Cited

U.S. PATENT DOCUMENTS 4,018,264 4/1977 Albertson ..... 165/133
4,120,994 10/1978 Inoue ..... 165/133
4,216,819 8/1980 Notaro ..... 165/133
4,258,783 3/1981 Albertson ..... 165/133

FOREIGN PATENT DOCUMENTS 259 1/1979 Japan ..... 165/133
1375160 11/1974 United Kingdom .

*Primary Examiner*—John J. Zimmerman
*Attorney, Agent, or Firm*—Scully, Scott, Murphy & Presser

[57] ABSTRACT

A heat-transfer material is produced by: preparing a body of metal serving as a cathode; subsequently keeping a surface of the body and an anode in contact with a plating aqueous solution; and applying a direct electrical potential between the anode and the cathode to cause a plating current to flow through the plating solution to produce slime from the anode and to lay deposits of plating metal on the surface of the body and moving the slime to the surface of the body to lay deposits of the slime on the surface of the body, so that the deposits of plating metal and the deposits of the slime jointly form on the surface of the body a porous layer which has minuscule projections of electrodeposits densely formed on one surface of the layer directed away from the body.

4 Claims, 4 Drawing Sheets

HEAT-TRANSFER MATERIAL

BACKGROUND OF THE INVENTION

1. Field of the Invention

The present invention relates to a heat-transfer material utilized for example as a condenser tube or an evaporator tube of a heat exchanger for use in an air conditioner, or as a heat pipe, and to a method of producing the same.

2. Related Art

Several effective ways to increase the efficiency of heat-transfer in a heat-transfer tube are generally known: (1) increasing the heat-transfer area; (2) causing a turbulent flow; (3) causing capillarity; and (4) causing nucleate boiling. As a heat-transfer tube of which efficiency of heat-transfer is improved by the above-mentioned ways (1) and (2), a copper tube having spiral grooves formed in an inner periphery thereof is conventionally employed. However, when rolling the spiral grooves in the inner periphery of the tube by a rolling apparatus, the number and helix angles of the grooves are restricted due to the restrictions on the techniques of rolling operation and of making the rolling tools. As result, the efficiency of heat-transfer for the grooved tube can be increased to a level of only 1.2 to 1.5 times that of a tube with no grooves, thereby being not sufficient. In addition, a great force is required to roll the grooves in the manufacture of the grooved tube since great friction is exerted between the rolling tool and the inner surface of the tube. Accordingly, a large rolling apparatus is required, and besides the service life of the tool is short, thereby increasing the manufacturing cost.

Further, as a heat-transfer material improved by the above-mentioned way (4), which way is considered to be most effective, a material of metal having a porous layer formed on a surface thereof by a sintering method or a brazing method is known. The conventional heat-transfer material, however, does not have sufficient efficiency of heat-transfer either. In addition, although the porous layer can be easily formed by means of sintering or brazing for a plate-like heat-transfer material, it has been difficult to form such a porous layer on the inner surface of a tubular member such as a heat-transfer copper tube by the method.

SUMMARY OF THE INVENTION

It is therefore an object of the present invention to provide a heat-transfer material comprising a body of metal having on a surface thereof a porous layer which ensures that nucleate boiling is sufficiently caused, so that the material has an excellent efficiency of heat-transfer. Another object of the present invention is to provide a method of producing the heat-transfer material, by which method the material including the porous layer having excellent heat-transfer characteristics can be easily produced at a substantially reduced manufacturing cost.

According to the first aspect of the present invention, there is provided a heat-transfer material comprising a body made of metal including a porous layer on a surface thereof, the porous layer having minuscule projections of electrodeposits densely formed on one surface of the layer directed away from the body.

According to another aspect of the present invention, there is provided a method of producing the heat-transfer material comprising the steps of preparing a body made of metal serving as a cathode, subsequently keeping a surface of the body and an anode in contact with a plating solution, the anode being soluble to the plating solution on electroplating, and subsequently applying a direct electrical potential between the anode and the cathode to cause a plating current to flow through the plating solution to produce slime from the anode and to lay deposits of plating metal on the surface of the body and moving the slime to the surface of the body to lay deposits of the slime on the surface of the body, so that the deposits of plating metal and the deposits of the slime jointly form on said surface of said body a porous layer which has minuscule projections of electrodeposits densely formed on one surface of said layer directed away from said body.

DESCRIPTION OF PREFERRED EMBODIMENTS OF THE INVENTION

Figure 1:
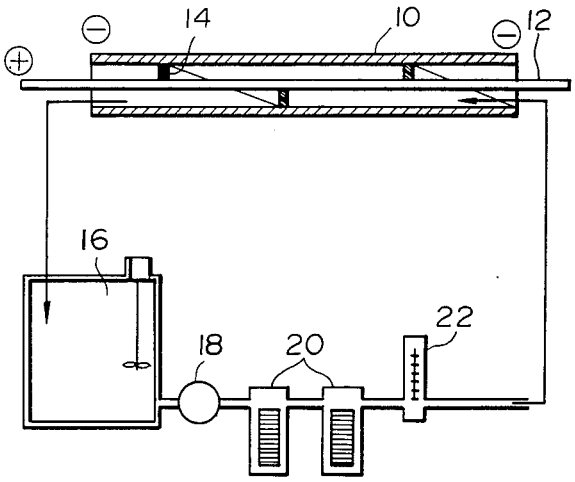
FIG. 1 is a schematic view showing an apparatus for practicing a method in accordance with the present invention.

In accordance with one embodiment of the method of the present invention, a tubular body of such metal as copper, aluminum and stainless steel is first prepared. A hydrophobic thin film then is formed on the inner surface of the body. There are several techniques which may be practiced to form the hydrophobic film. For example, a solution which contains hydrophobic substances such as grease, oil and dye dispersed or dissolved in a solvent is prepared, and the inner surface of the body is coated with the solution by a brush or a spray. The surface of the body may be immersed in the solution, and then removed from the solution to evaporate the solvent to leave the thin film of the hydrophobic substances.

As a next step the inner surface of the body, which serves as a cathode, is electroplated with a suitable plating solution for a prescribed period of time. In commencing the plating operation, a wire serving as a soluble anode is disposed in the tubular body so as to extend generally coaxially with the body. An elongated spacer made of an insulating material may be disposed spirally on the wire so as to keep the space from the wire to the inner surface of the body to prevent short circuit from occurring. The plating solution is caused to flow through the tubular body, and a direct electrical potential then is applied between the anode and the cathode to cause a plating current to flow through the plating solution until a plated layer is formed on the inner surface of the body. An anodic current density is regulated to such a level that slime is produced from the anode during the electroplating. The slime moves with the flow of the plating solution, and some reaches the inner surface of the body to form deposits of the slime thereon, and deposits of plating metal and the deposits of the slime jointly form the plated layer on the inner surface of the body. Since the slime is electroconductive, the deposits of plating metal grow in such a manner as to envelop the deposits of the slime, so that the plated layer becomes porous and has minuscule projections of electrodeposits densely formed on one surface of the layer directed away from the body. While the optimum anodic current density will vary depending upon the kinds of the anode, it should be at least 20 $A/dm^2$ in order to produce a sufficient amount of the anode slime to form the porous layer. Specifically, when the anodic current density is regulated to a relatively high value, a porous layer having dendritic or arborescent minuscule projections on a surface thereof is formed on the inner surface of the body. On the other hand, when a relatively low anodic current density is employed, a porous layer having a granular surface is formed on the inner surface of the body.

As described above, the heat-transfer tube thus produced has on its inner surface the porous layer which has the dendritic or granular minuscule projections of the deposits densely formed on the surface thereof. With this construction, not only capillarity is caused but also nucleate boiling develops sufficiently, so that the efficiency of heat-transfer is substantially increased. The heat-transfer tube thus obtained can be utilized as a heat pipe, in which the porous layer serves as wicks of the heat pipe. The heat pipe can transport heat effectively in a desired direction regardless of the position of its heat source.

In the method described above, the plating metal begins to be deposited initially on the portions of the inner surface of the body, where the hydrophobic film is particularly thin or is broken, so that the dendritic or granular minuscule projections are easily formed. The step of forming the hydrophobic film, however, may be omitted. The flow rate of the plating solution should be in the range of 0.5 to 5 m/sec. If the flow rate is below 0.5 m/sec, it becomes difficult to cause the anode slime to flow to the surface of the body, so that only fragile deposits are plated. On the other hand, when the flow rate is regulated to be above 5 m/sec, no significant effect is recognized and besides the energy cost is increased.

The present invention will now be illustrated by the following examples:

EXAMPLE I

Referring to FIG. 1, a copper tube 10 having an outer diameter of 9.52 mm and a thickness of 0.35 mm was produced by reduction, and was cut into pieces so as to have a length of 1,000 mm. The inner surface of the tube 10 then was washed with trichloroethylene. Subsequently, an ethanol solution containing silicon oil in the strength of $\frac{1}{3}$ was held in the tube 10, and ethanol was evaporated to form a thin film of the silicon oil on the inner surface of the tube 10. A copper wire 12 of an outer diameter of 4 mm having an elongated spacer 14 of resin spirally mounted thereon was inserted inside the tube 10, and a force was exerted on the opposite ends of the wire 12 so that the wire is stretched to extend generally coaxially with the tube 10.

A copper sulfate plating solution was supplied from a reservoir 16 through a pump 18 to the copper tube 10, and circulated to the reservoir, the plating solution containing copper sulfate of 200 g/l and sulfuric acid 50 g/l. Filters 20 and a flowmeter 22 were, as shown in FIG. 1, mounted on the pipe connecting the pump 18 and the tube 10.

Figure 2:
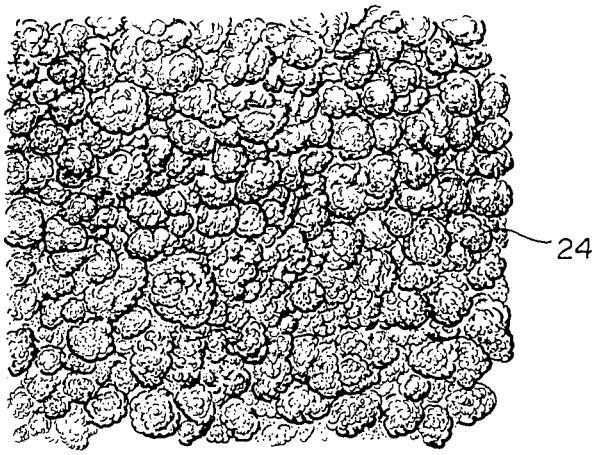
FIG. 2 is a view showing a surface of a heat-transfer material produced by the method in accordance with the present invention.

Electroplating then was carried out for a period of 15 minutes at a temperature of the plating solution of 30° C., a cathodic current density of 25 $A/dm^2$, an anodic current density of 60 $A/dm^2$ and a flow rate of plating solution of 1.5 m/sec resulting in a porous layer 24 of deposit copper on the inner surface of the tube 10. The layer 24 was found to be of an average thickness of 50 $\mu m$ and to have granular minuscule projections densely and uniformly disposed on a surface thereof, as shown in FIG. 2.

After cleaning of the inner surface of the heat-transfer tube 10 thus obtained, the tube 10 was dried and subjected to crash testing by a vise. In the test, neither peeling-off nor falling-off of the deposit metal was observed, resulting in excellent adhesion and strength of the porous layer.

Further, a heat-transfer tube was obtained in accordance with the method described above, and was subjected to testing for the heat-transfer characteristics and to comparison testing therefor with a conventional copper tube.

Figure 3:
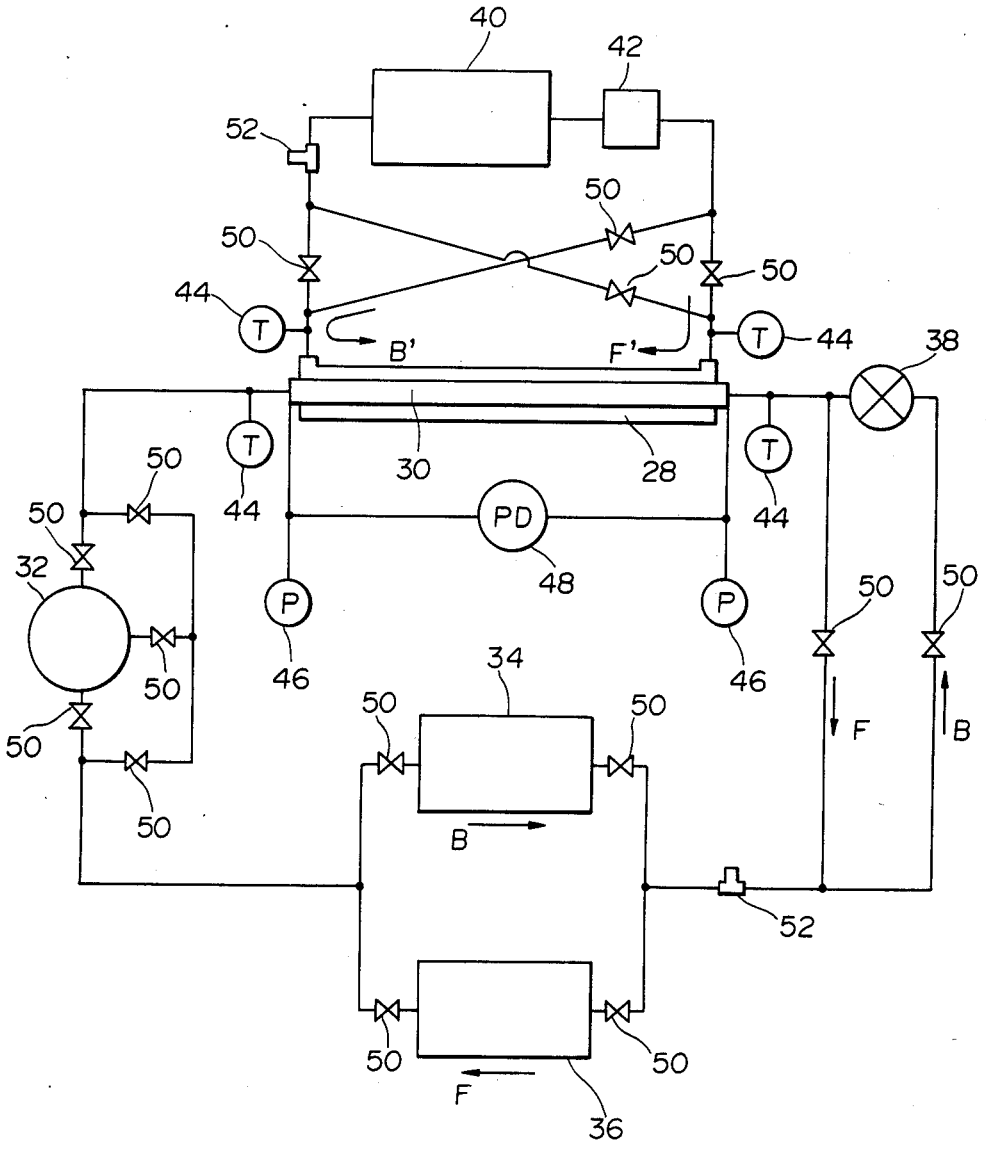
FIG. 3 is a schematic view of a device for testing the heat-transfer characteristics of a heat-transfer material.

FIG. 3 shows a testing device used for the tests. The device comprises a shell 28 in which the heat-transfer tube 30 to be tested is inserted, a compressor 32 connected to one end of the tube, a subcondenser 34 and a subevaporator 36 which are disposed in parallel to each other and connected at their one ends to the compressor, an expansion valve 38 connected at its one end to the other ends of the subcondenser and subevaporator and at its other end to the other end of the tube, a constant temperature bath 40 connected to one end of the shell and a pump 42 connected at its inlet to the bath and at its outlet to the other end of the tube. The shell and tube constitutes a double-pipe heat exchanger. The device also includes a plurality of temperature detectors 44, pressure gauges 46, a differential pressure gauge 48, valves 50 and orifice flowmeters 52.

By using the device, evaporative and condensation tests were carried out. In the evaporative test, as designated by arrows B in FIG. 3, the compressor 32 delivers the hot compressed refrigerant gas or freon gas to the subcondenser 34, where it is condensed. From the subcondenser, the liquid refrigerant flows through the expansion valve 38 to the heat-transfer tube 30 to be tested. In the tube, the liquid refrigerant is evaporated into a gas absorbing the heat from the counterflows of the warm water which passes through the shell 28. From the tube, the refrigerant gas returns to the compressor to repeat the cycle. The warm water in the constant temperature bath 40 is circulated by the pump 42 through the shell 28 in a closed circuit, as designated by arrows B'. Suppose that the temperature of the warm water decreases from $T_1$ to $T_2$ in the shell and that the refrigerant is evaporated at a temperature of $T_\theta$. Then the film coefficient of heat-transfer for the refrigerant side or boiling heat-transfer coefficient $\alpha_i$ for the heat-transfer tube is obtained by the following conventional equation.

$$\alpha_i = 1/[(1/U) - (1/\alpha_0)]$$

wherein $U = Q/A\Delta Tm$ $Q = CW(T_1 - T_2)$ $\alpha_0 = 0.023 \times (\lambda/De) \times Re^{0.8} \times Pr^{\frac{1}{3}}$ $De = (D_2^2 - D_1^2)/D_1$ $\Delta Tm = [(T_1 - T_{\frac{1}{4}}) - (T_2 - T_{\frac{1}{4}})]/[ln(T_1 - T_{\frac{1}{4}})/(T_2 - T_{\frac{1}{4}})]$ and wherein Q=heat transfer rate between the refrigerant and the warm water, C=specific heat, W=mass flow rate of warm water, $\alpha_0$=film coefficient of heat-transfer for the water side, U=overall coefficient of heat-transfer, A=surface area of heat-transfer, $\Delta Tm$=logarithmic mean temperature difference, Re=Reynolds number, Pr=Prandtle number, $\lambda$=coefficient of thermal conductivity of water, $D_1$=inner diameter of the tube and $D_2$=outer diameter of the tube.

Similarly, in the condensation test, the refrigerant and the warm water are caused to flow in the directions designated by arrows F and F', respectively, and the film coefficient of heat-transfer is obtained by similar equations.

In the test, the device was automatically controlled so that the parameters, which are shown in TABLE 1, were regulated to the predetermined values. The mass flow rate of the refrigerant was varied, and the boiling heat-transfer coefficient was calculated and plotted against te flow rates of the refrigerant.

TABLE 1

| | evaporation | condensation |
|---|---|---|
| mass flow rate of refrigerant (kg/hr) | 40,60,80 | 40,60,80 |
| temperature of evaporation (°C.) | 5 ± 0.5 | 5 ± 0.5 |
| superheating temperature (°C.) | 5 ± 0.5 | 5 ± 0.5 |
| temperature at the expansion valve inlet (°C.) | 35 ± 0.5 | 35 ± 0.5 |
| temperature of condensation(°C.) | 45 ± 0.5 | 45 ± 0.5 |
| subcooling temperature (°C.) | 10 ± 0.5 | 5 ± 0.5 |
| volumetric flow rate of water (1/min) | 8–10 | 8–10 |
| temperature of water (°C.) | 20–25 | 30–35 |

Figure 4:
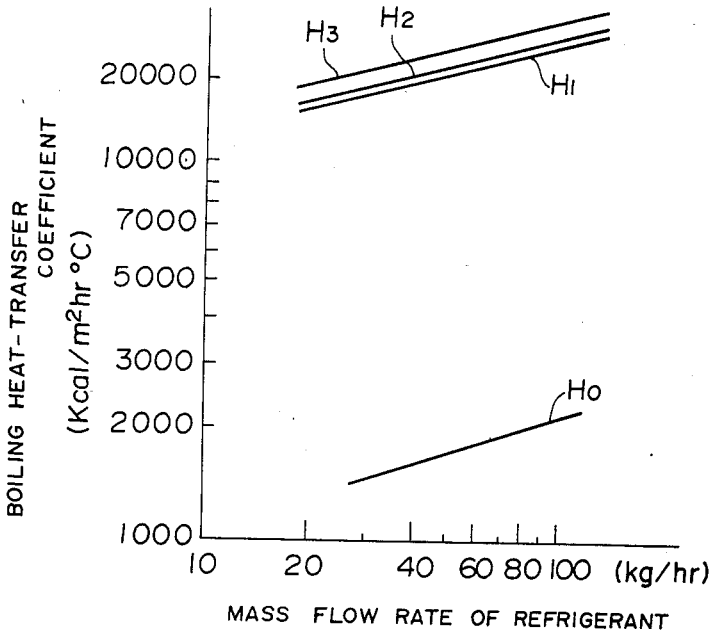
FIG. 4 is a graphical presentation showing plots of experimental results on the heat-transfer characteristics obtained by the device of FIG. 3 for heat-transfer materials produced in accordance with the present invention and for a conventional heat-transfer material.

The results obtained are graphically depicted in FIG. 4, in which $H_1$ denotes a result for the heat-transfer tube produced according to the above-mentioned method while $H_0$ denotes a result for the conventional copper tube. It is evident from FIG. 4 that the boiling heat-transfer coefficient for the heat-transfer tube produced according to the above-mentioned method is around ten times as great as that for the conventional copper tube.

EXAMPLE II

Figure 5:
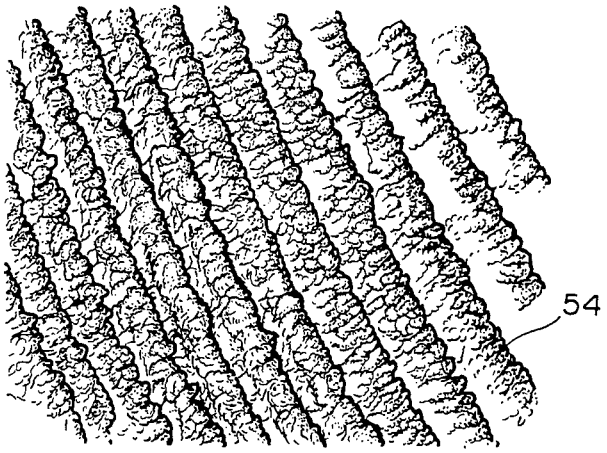
FIG. 5 is a view showing a surface of a heat transfer material produced by a modified method in accordance with the present invention.

Spiral grooves were formed by rolling in the inner peripheral surface of a copper tube having the same size as that in EXAMPLE I, and the procedure described in EXAMPLE I was repeated, resulting in a porous layer 54 of deposit metal having granular minuscule projections densely formed on the surface thereof, as shown in FIG. 5. The layer was formed not only on the inner peripheral surface of the tube but also on the inner surface of the grooves. The tube thus obtained was subjected to testing for the heat transfer characteristics as described in EXAMPLE I. The result is also graphically depicted by $H_2$ in FIG. 4. From FIG. 4, it is evident that the boiling heat-transfer coefficient for the tube is greater than that for the tube in accordance with EXAMPLE I.

EXAMPLE III

Figure 6:
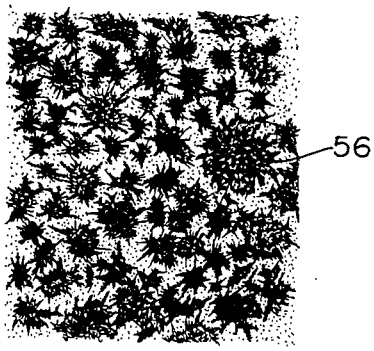
FIG. 6 is a view showing a surface of a heat-transfer material produced by a further modified method in accordance with the present invention.

The procedure described in EXAMPLE I was repeated with the exception that the electroplating was carried out for a period of 10 minutes at a cathodic current density of 35 A/dm$^2$, an anodic current density of 84 A/dm$^2$ and a flow rate of the plating solution was 1.5 m/sec, resulting in a porous layer 56 of deposit metal having dendritic minuscule projections densely formed on the surface thereof, as shown in FIG. 6. The heat-transfer tube thus obtained was then subjected to testing for the heat transfer characteristics according to the method described in EXAMPLE I under the same conditions with a result that, as shown by $H_3$ in FIG. 4, the boiling heat-transfer coefficient for the tube in accordance with the above-mentioned method is greater than those for the tubes of EXAMPLES I and II.

EXAMPLE IV

Figure 7:
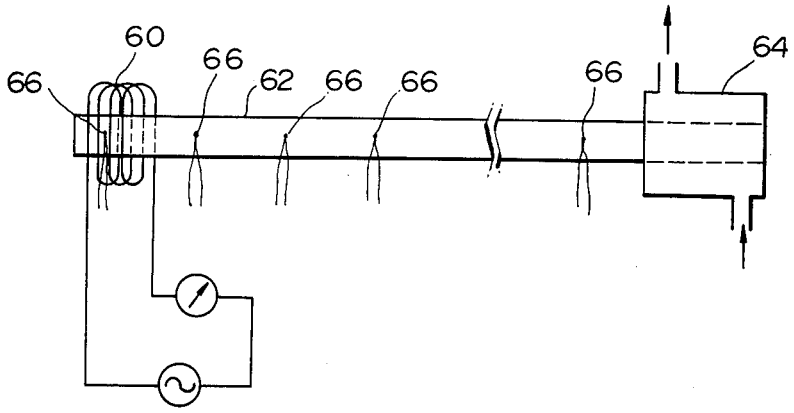
FIG. 7 is a schematic view showing a measuring equipment for the heat-transfer characteristics of heat pipes.

Copper tubes each having an outer diameter of 9.52 mm, a thickness of 0.30 mm and a length of 300 mm were prepared, and the procedures described in EXAMPLES I, II and III were repeated. Subsequently, the heat-transfer tubes thus produced and a conventional copper tube were subjected to testing for the performance as heat pipes, respectively. Namely, each of the pipes was disposed horizontally, and water was kept in each pipe in sealing relation thereto as an operating fluid, and the amount of heat transported by each heat pipe was measured by a measuring apparatus as shown in FIG. 7. The apparatus comprises an electric heater 60 attached to one end of the heat pipe 62, a water jacket 64 disposed on the other end of the pipe and a plurality of thermocouples 66 attached on the outer periphery of the pipe in axially spaced relation to one another. An electrical power supplied to the heater and a flow rate of water to the water jacket were so regulated that the temperature at the outer periphery of the pipe was maintained to generally 100° C., and the amount of heat transported by the heat pipe was calculated from the data on the temperature difference between the inlet and outlet of the water jacket. The results will be shown in TABLE II.

TABLE II

| test pipe | amount of heat transported |
|---|---|
| heat pipe produced by the method of EXAMPLE I | 72 W |
| heat pipe produced by the method of EXAMPLE II | 84 W |
| heat pipe produced by the method of EXAMPLE III | 90 W |
| conventional copper tube | 25 W |

From TABLE II, it is evident that the heat pipes produced in accordance with the methods of EXAMPLES I, II and III are superior in the amount of heat transport to the conventional heat pipe, the amounts of heat transport of these heat pipes being 2.9, 3.3 and 3.6 times that for the conventional copper tube, respectively. The reasons why the heat pipes produced in accordance with the methods of EXAMPLES I, II and III are superior are considered to be as follows. Firstly, thanks to the porous layer, not only a heat-transfer area is increased but also the evolution of nucleate boiling of the operating fluid is facilitated to cause phase transition between liquid and gas to easily occur in its heat-delivery side, so that the efficiency of heat-transfer is substantially increased. Secondly, since the porous layer has dendritic or granular minuscule projections of metal deposits densely formed on its surface, pores or cavities of the layer are sufficiently fine and in communication with each other, so that capillarity is easily caused to facilitate the carriage of the operating fluid liquefied in its heat-receiving side to the heat-delivery side.

As exemplified above, the method in accordance with the present invention is simple to practice and does not require any complicated or large apparatus, thereby being cost-saving as compared with the prior methods. Particularly, the method can be employed not only to form a porous heat-transfer layer on a surface of a flat body or the outer peripheral surface of a tubular body such as a copper tube but also to form such a layer in the inner peripheral surface of the tubular body of a small diameter, and besides it is possible to easily regulate heat-transfer characteristics of the material obtained by regulating the parameters such as the current densities when producing the material. In addition, the heat-transfer material produced in accordance with the present invention has on its surface a porous deposit layer having dendritic or granular minuscule projections densely formed on the surface of the layer. Accordingly, since not only capillarity is caused but also nucleate boiling develops with the heat-transfer material, the material has the efficiency of heat-transfer substantially increased as compared with the prior material, resulting in the use for not only excellent heat-transfer tubes for an apparatus such as a heat exchanger but a heat pipe of high performance as well.

Obviously many modifications and variations of the present invention are possible in the light of the above teachings. It is therefore to be understood that within the scope of the appended claims, the invention may be practiced otherwise than as specifically described.

What is claimed is:

1. A heat transfer material having a tubular body made of metal, a porous electroplated layer on at least one of an inner or outer surface thereof, and minuscule projections of electrodeposits densely formed on said porous layer directed away from said tubular body, said heat transfer material being produced by the steps of:

(a) preparing said tubular body made of metal serving as a cathode, and forming a hydrophobic film on at least one of said inner and outer surface of said body;

(b) subsequently keeping said at least one surface of said body and an anode in contact with a plating solution, said anode being soluble to said plating solution on electroplating; and (c) subsequently applying a direct electrical potential between said anode and said cathode to cause a plating current to flow through said plating solution to produce slime from said anode and to lay deposits of plating metal on said surface of said body, and moving said slime to said surface of said body, so that said deposits of plating metal and said deposits of said slime jointly form on said surface of said body said porous layer having said minuscule projections of electrodeposits densely formed on one surface of said layer directed away from said body.

2. A heat-transfer material produced according to the process of claim 1, in which said body is made of copper, said plating aqueous solution being cooper sulfate aqueous solution.

3. A heat-transfer material produced according to the process of claim 1, in which said body and said plating solution are moved relative to each other at a velocity of 0.5 to 5 m/sec to cause said slime to flow to said surface of said body.

4. A heat transfer material produced according to the process of claim 1, in which an anodic current density is not less than 20 $A/dm^2$.

* * * * *

UNITED STATES PATENT AND TRADEMARK OFFICE

CERTIFICATE OF CORRECTION

PATENT NO. : 4,780,373

DATED : October 25, 1988

INVENTOR(S) : Yasuo Masuda, et al

It is certified that error appears in the above-identified patent and that said Letters Patent is hereby corrected as shown below:

Column 1, lines 24-25: "As result" should read as --As a result--

Column 5, line 9: "$\Delta Tm=[(T_1-T_{\frac{1}{4}})-(T_2-T_{\frac{1}{4}})]/[\ln(T_1-T_{\frac{1}{4}})/(T_2-T_{\frac{1}{4}})]$" should read as -- $\Delta Tm = [(T_1-T_\theta)-(T_2-T_\theta)]/[\ln(T_1-T_\theta)/(T_2-T_\theta)]$

Signed and Sealed this

Thirty-first Day of December, 1991

*Attest:*

HARRY F. MANBECK, JR.

*Attesting Officer*

*Commissioner of Patents and Trademarks*